US010801313B2

(12) United States Patent
Head et al.

(10) Patent No.: US 10,801,313 B2
(45) Date of Patent: Oct. 13, 2020

(54) MOTOR AND PUMP PARTS

(71) Applicant: Coreteq Systems Ltd., Surrey (GB)

(72) Inventors: Philip Head, Virginia Water Surrey (GB); Hassan Mansir, Maidenhead (GB)

(73) Assignee: Coreteq Systems Ltd., Surrey (GB)

( * ) Notice: Subject to any disclaimer, the term of this patent is extended or adjusted under 35 U.S.C. 154(b) by 70 days.

(21) Appl. No.: 15/569,934

(22) PCT Filed: Apr. 28, 2016

(86) PCT No.: PCT/GB2016/051226

§ 371 (c)(1),
(2) Date: Oct. 27, 2017

(87) PCT Pub. No.: WO2016/174453

PCT Pub. Date: Nov. 3, 2016

(65) Prior Publication Data

US 2018/0156241 A1 Jun. 7, 2018

(30) Foreign Application Priority Data

Apr. 28, 2015 (GB) ..... 1507261.4

(51) Int. Cl.
*F04D 29/70* (2006.01)
*F04D 13/10* (2006.01)
(Continued)

(52) U.S. Cl.
CPC ..... *E21B 43/38* (2013.01); *E21B 43/128* (2013.01); *F04D 13/10* (2013.01); *F04D 13/12* (2013.01);
(Continued)

(58) Field of Classification Search
CPC .... F04D 29/708; F04D 13/086; F04D 29/047; F04D 13/12; F04D 29/061; F04D 13/10;
(Continued)

(56) References Cited

U.S. PATENT DOCUMENTS 2,363,419 A * 11/1944 Howard ..... F04D 29/061 417/367
3,288,075 A 11/1966 Lung
(Continued)

FOREIGN PATENT DOCUMENTS

EP 2 518 867 A1 10/2012
WO WO 2004/027211 A1 4/2004

OTHER PUBLICATIONS

International Search Report and Written Opinion for PCT/GB2016/051226 dated Sep. 5, 2016, 16 pages.

*Primary Examiner* — Michael R Wills, III
(74) *Attorney, Agent, or Firm* — Fay Sharpe LLP

(57) ABSTRACT

A separator for reducing or eliminating the amount of suspending solids from a reservoir fluid of a downhole motor having a rotating seal. The cleaned fluid circulated past the seal and outermost bearing, the separator having a vortex, rotating cyclone or centrifuge, at least one inlet at least one outlet for cleaned fluid, at least one outlet for solid material, water, particulates or similar material separated from the cleaned fluid. The outlet for the clean fluid may include a porous filter.

11 Claims, 4 Drawing Sheets

(51) Int. Cl.

| | |
|---|---|
| ***F04D 29/06*** | (2006.01) |
| ***F04D 29/047*** | (2006.01) |
| ***E21B 43/12*** | (2006.01) |
| ***E21B 43/38*** | (2006.01) |
| ***F04D 13/12*** | (2006.01) |
| *E21B 34/06* | (2006.01) |
| *E21B 43/08* | (2006.01) |
| *F04C 2/16* | (2006.01) |
| *F04C 2/18* | (2006.01) |
| *F04D 1/06* | (2006.01) |

(52) U.S. Cl.
CPC ..... *F04D 29/0473* (2013.01); *F04D 29/061* (2013.01); *F04D 29/708* (2013.01); *E21B 34/06* (2013.01); *E21B 43/08* (2013.01); *F04C 2/16* (2013.01); *F04C 2/18* (2013.01); *F04D 1/06* (2013.01)

(58) Field of Classification Search
CPC ... F04D 29/0473; F04D 1/06; B01D 21/0012; B01D 17/0217; B01D 21/26; E21B 43/38; E21B 43/08; E21B 34/06; E21B 43/128; F04C 2/16; F04C 2/18
USPC ..... 415/110, 111, 112
See application file for complete search history.

(56) References Cited

U.S. PATENT DOCUMENTS

| | | | | |
|---|---|---|---|---|
| 4,276,002 | A * | 6/1981 | Anderson | F04D 13/10 415/112 |
| 4,553,909 | A | 11/1985 | Galais et al. | |
| 4,833,354 | A | 5/1989 | Miller | |
| 5,494,109 | A | 2/1996 | Schmitt | |
| 6,601,651 | B2 * | 8/2003 | Grant | E21B 43/121 166/106 |
| 8,757,256 | B2 * | 6/2014 | Li | E21B 43/38 166/105.5 |
| 2004/0144534 | A1 | 7/2004 | Lee | |
| 2007/0096571 | A1 | 5/2007 | Yuratich | |
| 2009/0091202 | A1 | 4/2009 | Parmeter et al. | |
| 2009/0304526 | A1 | 12/2009 | Ford | |
| 2013/0136639 | A1 | 5/2013 | Simpson | |
| 2013/0319956 | A1 | 12/2013 | Tetzlaff et al. | |
| 2015/0064034 | A1 | 3/2015 | Davis et al. | |

* cited by examiner

SCREW TYPE PUMP OR MOTOR
described in US 2013/0136639 A1

MOTOR AND PUMP PARTS

CROSS-REFERENCE TO RELATED APPLICATIONS

This application is a National Stage Entry of PCT/GB2016/051226, and claims priority to, and the benefit of, Great Britain Patent Application No. GB 1507261.4, filed Apr. 28, 2015, the entirety of which is hereby incorporated by reference as if fully set forth herein.

FIELD OF THE INVENTION

The invention relates to motor and pump parts, particularly a vortex fluid separator and filter to lubricate motor bearing, pump bearings and provide a boundary layer for pumping parts.

BACKGROUND OF THE INVENTION

In a variety of wellbore environments, electric submersible pumping systems are used to lift fluids from a subterranean location. Although electric submersible pumping systems can utilize a wide variety of components, examples of basic components comprise a submersible pump, a submersible motor and a motor protector. The submersible motor powers the submersible pump, and the motor protector seals the submersible motor from well fluid.

The motor protector also balances the internal motor oil pressure with external pressure. Motor protectors often are designed with a labyrinth system and/or an elastomeric bag system. The labyrinth system uses the difference in specific gravity between the well fluid and internal motor oil to maintain separation between the fluids. The elastomeric bag system relies on an elastomeric bag to physically isolate the motor oil from the well fluid while balancing internal and external pressures. Additionally, motor protectors often have an internal shaft that transmits power from the submersible motor to the submersible pump. The shaft is mounted in journal bearings positioned in the motor protector.

Such protectors function well in many environments. However, in abrasive environments, the run life of the motor protector can be detrimentally affected. The abrasive sand causes wear in motor protector components, such as the journal bearings. Attempts have been made to increase run life by populating the motor protector with journal bearings made from extremely hard materials to reduce wear caused by the abrasive sand.

This invention relates to separating cleaned oil from the produced fluid to provide a flushing lubricate for motor bearings, pump bearings and pump moving surfaces.

A screw pump is used to boost the pressure of the flushing oil to be equal to the pump discharge pressure.

Discharge at each bearing is regulated by a combination of the external pressure at that point and a flow control device such as a Lee Viscojet The object of the present invention is to provide motor protection having better reliability.

SUMMARY OF THE INVENTION

According to the present invention, there is provided a means for preventing sand/solids from entering the motor rotor cavity.

According to further aspect of the invention, there is provided a means for preventing sand/solids from entering the motor protector rotor cavity.

According to a further aspect of the invention a vortex separator is used separate the solids and water from the reservoir oil as a primary filter means.

According to a further aspect of the invention a porous filter means is used as a secondary filter.

According to a further aspect of the invention, all the bearings are continuously flushed with filtered well bore fluid.

According to further aspect of the invention, the motor rotor cavity is pressure balanced by a filter medium which allows fluid to both enter and leave the rotor cavity but no solids can enter the rotor cavity.

According to a further aspect of the invention the flushing fluid could be energised by a screw pump.

According to a further aspect of the invention the flushing fluid could be energised by a gear pump.

According to a further aspect of the invention the rotor cavity will operate with filtered wellbore fluids.

According to a further aspect of the invention, the rotor cavity will match the pressure outside of the motor instantaneously as the filter medium provides direct communication between the two.

According to a further aspect of the invention, the pump bearings will be lubricated with filtered fluid.

BRIEF DESCRIPTION OF THE DRAWINGS

Referring to FIG. 1 there is shown a housing 1 with a flange 2 which connects to the output of a motor, typically via a protector (not shown). The assembly has a shaft 3 passing through its centre, which is mounted in bearings 4, 5. The outer housing 6 extends to an upper flange 7. Inlet ports 8 allow wellbore fluids to be drawn into the chamber 9 which is the inlet to the vortex separator 10. The vortex separator rotates with the shaft 1. The vortex separator has an outer wall 15 that has a funnel-shaped portion with a relatively wide diameter at its top 12 and tapers towards a relatively narrow diameter 11. An inner surface 28 has a constant diameter, so that the area 14 at the top of the funnel-shape then diminishes towards a more constricted area towards the base of the funnel-shape. With the turning of the vortex separator 10, as fluid and suspension mixture is introduced into the vortex separator from the chamber 9, the separator draws and separates the solids and water to flow along the wall 15 and through the outlet 43 while the lower density oil will flow to the upper edge 16 of the inner surface 28 and drawn into the filter 17. The oil passes downwards through the filter 17 into gallery 18, and then into the screw pump inlet 19. The screw pump consists of a main central screw 20, which is part of the main shaft 3 passing through the assembly, and two idle screw gears shafts 21 and 22 which are driven by the main screw 20. The oil is drawn downwards through the screws and is discharged at the high pressure end into the ID 24 of the shaft 3 via a passage 23. A rotating high pressure seal 25 provides a barrier at the interface of shaft 3 and housing 1. The pressure of the discharge of the screw pump is at least equal to the discharge pressure of the production fluid pump. At each bearing the pressurised oil passes through a "Lee Viscojet" miniature hydraulic choke 27 which controls the flow of oil into the bearing 5.

Other forms of pump may be used, provided they are capable of developing a high pressure sufficient to overcome the discharge pressure of the production fluid pump.

Since solids are separated by the action of the vortex, it may be found that the filter 17 is unnecessary, and the fluid directed to the centre of the separator has been sufficiently cleaned to be used without further filtering.

If a filter is used, the direction of the fluid flow could periodically be reversed in order to flush the filter and release any build up of particulate matter which could clog the filter.

Figure 1:
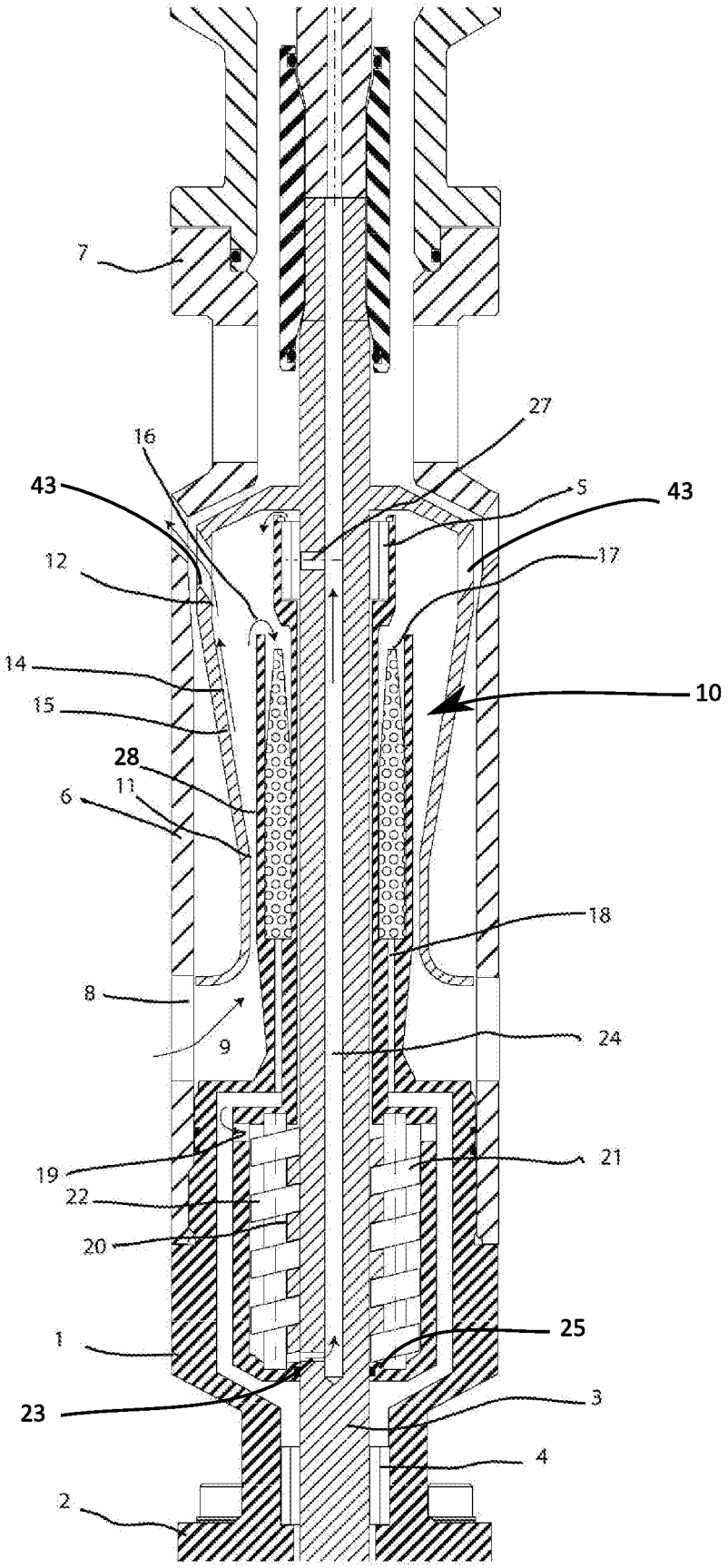
FIG. 1 is a section side view of the vortex separator and screw bearing lubrication boost pump.
Figure 2:
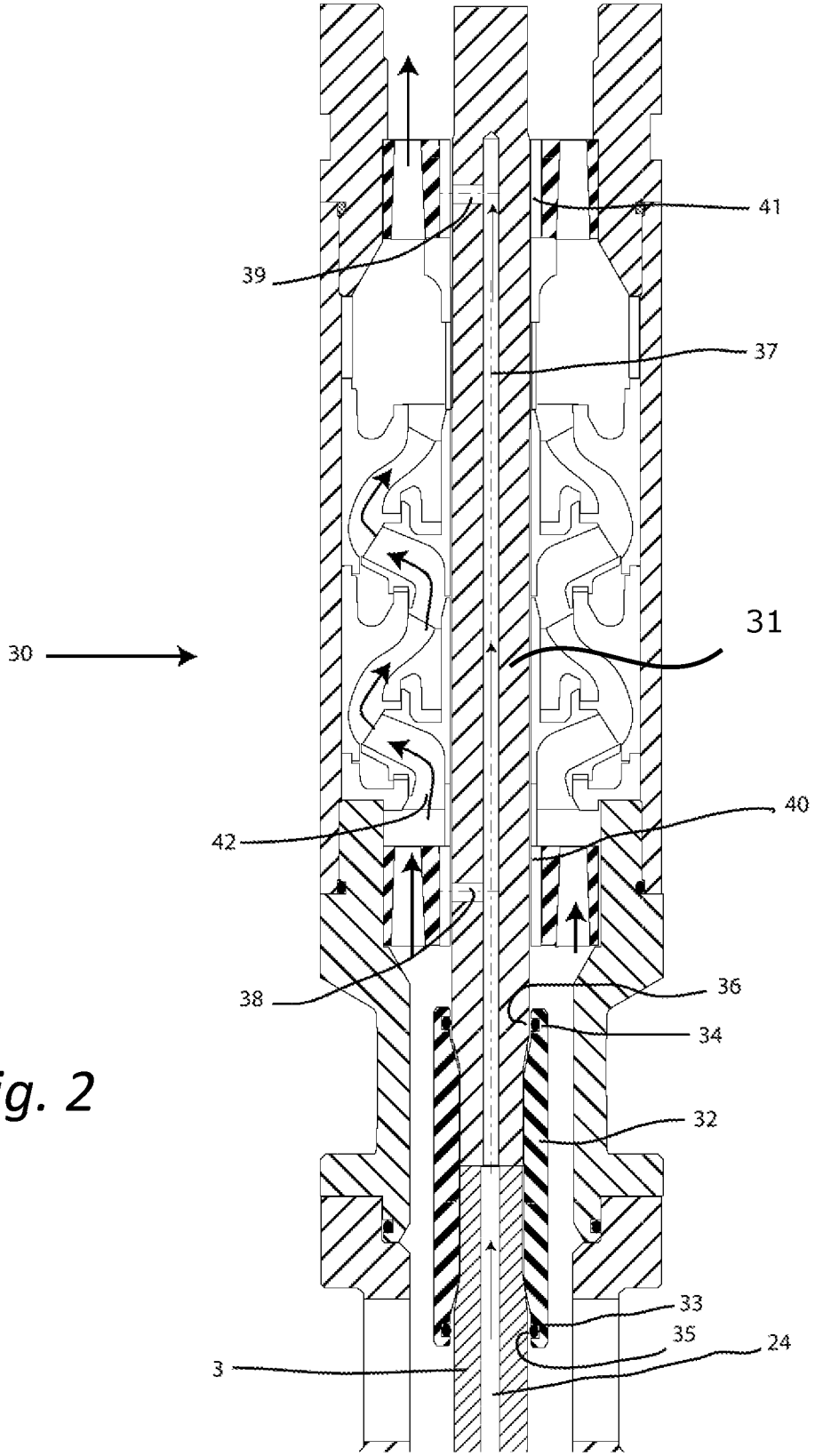
FIG. 2 is a section side view through a multi stage centrifugal pump.

Referring to FIG. 2 there is shown a multi stage centrifugal pump assembly 30, the shaft 3 transmitting the power through the vortex separator, drives the pump shaft 31 via a coupling 32. At each end of the coupling are 0 rings 33, 34 which seal respective surfaces 35, 36. The pressurized oil from the screw pump in passage 24 is also supplied into the ID 37 of the pump shaft 31, to feed the bearings 40, 41 via ports 38, 39. At each bearing the pressurised oil passes through a "Lee Viscojet" miniature hydraulic choke in the port 38 and 39 which controls the flow of oil into the bearing 40, 41. The excess oil passing through the bearing comingles with the production fluid 42.

Figure 3:
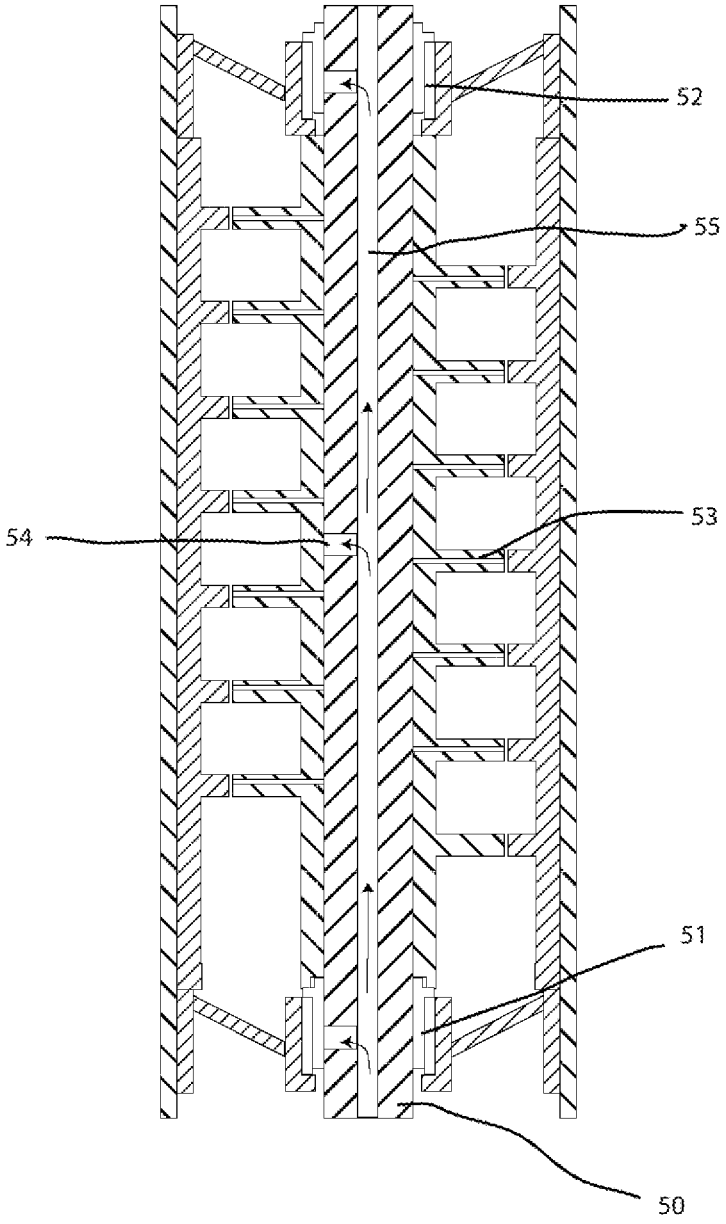
FIG. 3 is a section side view through a screw type pump.
Figure 4:
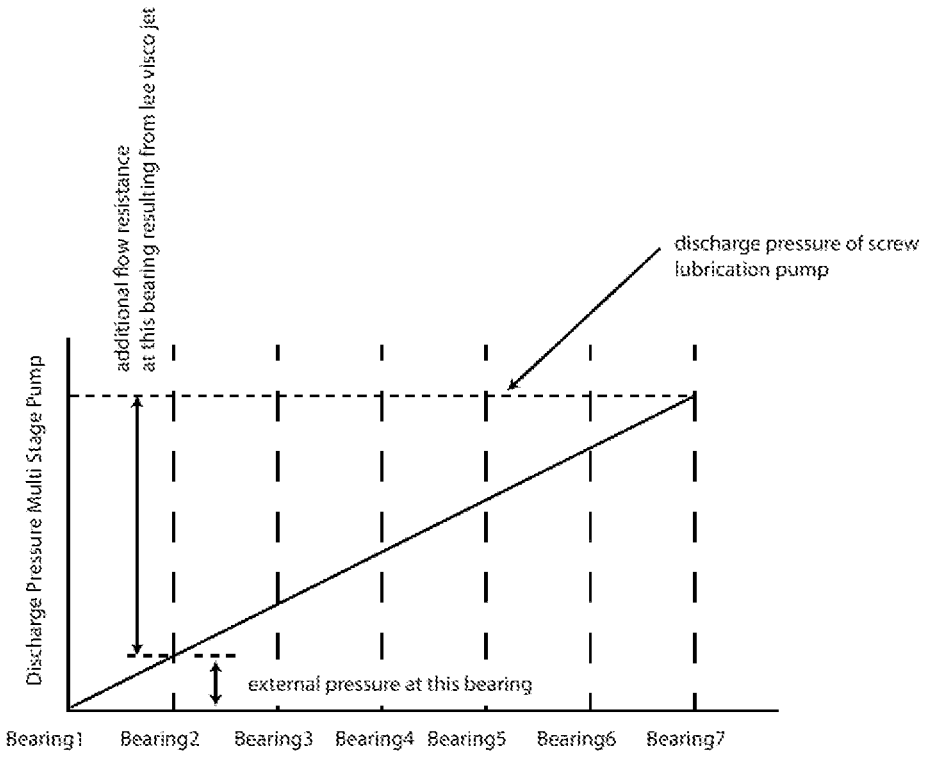
FIG. 4 is a graph illustration the external pressure at each pump bearing and the discharge pressure of the screw pump shown is FIG. 1.

Referring to FIG. 3 there is shown a screw type pump, fully disclosed in US patent number 2013/0136639A1. This particularly lends itself to this application, in that it has a larger diameter drive shaft 50, and generates a greater pressure lift per stage, so requires fewer stages and hence fewer bearings 51, 52. It also has the advantage of having ports 53 through which clean fluid is fed, so continually flushing the moving outer surface of the screw pump with clean liquid and displacing any particulates such as formation sand away. The flushing fluid has to pass through a "Lee Viscojet" 54 to ensure the clean liquid flows at a controlled rate and the pressure inside the gallery 55 is maintained at the final discharge pressure. This is shown more clearly in FIG. 4. For a pump with 6 stages, there would be 7 bearings, for each new stage added, the discharge pressure at the end of that stage would be incrementally greater. At the end of the last stage added would be the maximum pump discharge pressure. The pressure inside the shaft would have to be equal to the maximum pump discharge pressure so that it can flush the final bearing 7. However, at each of the bearings 5, 4, the pressure required to flush the bearing is incrementally less. Hence, by adding a Lee Viscojet at each of these discharge points the amount of liquid that will exit and flush any one bearing is regulated, therefore uniform leakage along the entire shaft flow exit points is achieved. The screw pump can be sized to have a small flow rate to just flush the bearings, or it can be sized to have a higher flow rate so that it can flush both the bearings and the pump outer surfaces, preventing formation fines and solids from eroding the pump.

The invention claimed is:

1. A separator for reducing or eliminating the amount of suspending solids from a reservoir fluid of a downhole motor, having a rotating seal, cleaned fluid circulated past the seal and a bearing, the separator comprising a vortex comprising a rotating outer wall having a funnel shape and an inner surface having a constant diameter, at least one inlet located adjacent the base of the funnel shape where the distance between the funnel shape and an inner surface is a minimum, the rotation of the outer wall being sufficient to cause a vortex effect, at least one outlet for cleaned fluid located at the top of the inner surface, and at least one outlet located at the top of the funnel shape where the distance between the funnel shape and an inner surface is a maximum for solid material, water, particulates or similar material separated from the cleaned fluid.

2. The separator according to claim 1, wherein the outlet for the clean fluid includes a porous filter housed in an annulus between the central shaft and the inner surface.

3. The separator according to claim 2, including multiple bearings at different positions along a pump shaft, with different fluid pressures at each bearing.

4. The separator according to claim 3, wherein lee choke valves are used to choke the fluid pressure at each bearing.

5. The separator according to claim 4, wherein the lee choke valves have a different choke value to match the external pressure around the bearing at its location in the pump, the internal pressure inside the central shaft being sufficient to flush the bearing at the pump outlet which will be the greatest differential pressure.

6. The separator according to claim 1, further including a fluid path through the central shaft, and including a pump in communication with a gallery beneath the porous filter, the pump urging the cleaned fluid up through the central shaft.

7. The separator according to claim 6, wherein the cleaned fluid is energised by a screw pump.

8. The separator according to claim 1, wherein a rotating shaft drives the separator.

9. The separator according to claim 1, further including a fluid path through multiple bearings.

10. The separator according to claim 1, wherein there the cleaned fluid lubricates and flushes the bearings.

11. The separator according to claim 1, wherein a porous filter is used as a secondary filter.

* * * * *